United States Patent [19]

Lee et al.

[11] Patent Number: 4,782,768

[45] Date of Patent: Nov. 8, 1988

[54] ROTARY COMBUSTOR WITH EFFICIENT AIR DISTRIBUTION

[75] Inventors: Suh Y. Lee, Monroeville; Graham A. Whitlow, Murrysville, both of Pa.

[73] Assignee: Westinghouse Electric Corp., Pittsburgh, Pa.

[21] Appl. No.: 92,849

[22] Filed: Aug. 24, 1987

[51] Int. Cl.[4] ..... F27B 7/38; F27B 7/36

[52] U.S. Cl. ..... 110/246; 432/103; 432/105; 432/117

[58] Field of Search ..... 110/235, 246, 243; 432/103, 105, 113, 117

[56] References Cited

U.S. PATENT DOCUMENTS

| | | | |
|---|---|---|---|
| 2,220,944 | 11/1940 | Murray, Jr. . | |
| 2,336,339 | 12/1943 | Bennis . | |
| 2,670,722 | 3/1954 | Huet . | |
| 3,330,260 | 7/1967 | Seibold . | |
| 3,604,692 | 9/1971 | Smithwick | 432/117 |
| 3,814,062 | 6/1974 | Vollhardt . | |
| 3,822,651 | 7/1974 | Harris et al. . | |
| 3,838,665 | 10/1974 | Astrom . | |
| 3,916,807 | 11/1975 | Eiki | 432/105 |
| 4,066,024 | 1/1978 | O'Connor . | |
| 4,135,575 | 1/1979 | Gersch . | |
| 4,226,584 | 10/1980 | Ishikawa . | |
| 4,266,931 | 5/1981 | Struckmann | 432/105 |
| 4,638,857 | 1/1987 | Fournier . | |
| 4,735,157 | 4/1988 | Jurusz | 110/246 |

FOREIGN PATENT DOCUMENTS

| | | |
|---|---|---|
| 531330 | 10/1956 | Canada . |
| 954323 | 12/1949 | France . |
| 564649 | 10/1944 | United Kingdom . |
| 1559748 | 1/1980 | United Kingdom . |

*Primary Examiner*—Henry C. Yuen

[57] ABSTRACT

An improved rotary combustor has side walls with slanted openings. Air used to support combustion passes through the slanted openings and is directed at an acute angle to a vector in the direction of rotation of the combustion barrel. As a result, the air is directed towards the combustion area within the barrel.

13 Claims, 5 Drawing Sheets

ROTARY COMBUSTOR WITH EFFICIENT AIR DISTRIBUTION

BACKGROUND OF THE INVENTION

1. Field of the Invention

The present invention is related to a rotary combustor, or incinerator, for incinerating waste material in a combustion barrel and, more particularly, to an improvement in the generally cylindrical side wall of the combustion barrel for directing air supplied to the combustor to provide more efficient combustion.

2. Description of the Related Art

Proper disposal of solid waste has become an increasingly serious problem as existing sites for land disposal reach or approach capacity and new sites become increasingly difficult to locate. Incineration of combustible solid waste has long been used to reduce the quantity of solid matter needing disposal. However, existing methods of incineration often result in incomplete combustion and produce exhaust gases which include carbon monoxide and unburned hydrocarbons.

One device used to incinerate solid waste is a water-cooled rotary combustor which has been used in an increasing number of applications for the last one to two decades. Examples of water-cooled rotary combustors are described in U.S. Pat. Nos. 3,882,651 to Harris et al.; 4,066,024 to O'Connor; and 4,226,584 to Ishikawa, all of which are hereby incorporated by reference. A general description of a rotary combustor is provided immediately below and a more detailed description will be provided later.

As illustrated schematically in a cross-sectional side elevation view in FIG. 1, a water-cooled rotary combustor generally includes a combustion barrel 10 having a general cylindrical side wall 23 affixed to annular support bands 13 which are received on rollers 12 to permit rotation of the barrel 10 about its longitudinal axis. The barrel 10 has a generally open input end 16 for receiving material to be burned, such as municipal solid waste 14 which varies in moisture content and heating value. A second or opposite end 18 of the barrel 10 is disposed in a flue 28. Exhaust gases 20 and solid combustion products 22, i.e., ash, exit the combustion barrel 10 at the exit end 18. The barrel 10 is cooled by cooling pipes 24 joined by gas-porous interconnections 51, having opening 52, formed on a generally cylindrical side wall 23 of the barrel 10. Combustion gas, typically air, is supplied by windboxes, e.g., 32, 34 and 36, to the interior of the barrel 10 through the openings 52 to support the combustion of the waste material 14.

As illustrated in FIG. 2A, the rotation of the barrel 10 causes the waste material 14 to shift to one side with the result that combustion occurs primarily along one side of the barrel 10. However, the air which is supplied in a conventional combustor is not always directed towards the area of combustion, as indicated by air flow arrow 41. This results in less efficient combustion than would otherwise be possible.

SUMMARY OF THE INVENTION

An object of the present invention is to provide increased efficiency of combustion in rotary combustors.

Another object of the present invention is to minimize the discharge of carbon monoxide and unburned hydrocarbons from a rotary combustor utilized in a process of burning municipal solid waste.

The above objects are attained by providing a generally cylindrical side wall of a combustion barrel in a rotary combustor used for incinerating solid material with combustion gas from a combustion gas supply entering the interior of the combustion barrel through the side wall to support combustion of the material, the combustion barrel having input and exit ends and the side wall being connected to a coolant loop containing heat exchanging equipment and rotating in a direction of rotation about a central axis of rotation, the side wall comprising plural cooling pipes, extending longitudinally in parallel axial relationship, having connections to the coolant loop at at least one of the input and exit ends; and plural gas-porous interconnections having openings therein, the openings directing the combustion gas from the combustion gas supply into the interior of the combustion barrel at an acute angle to a vector corresponding to the direction of rotation.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENTS

Figure 1:
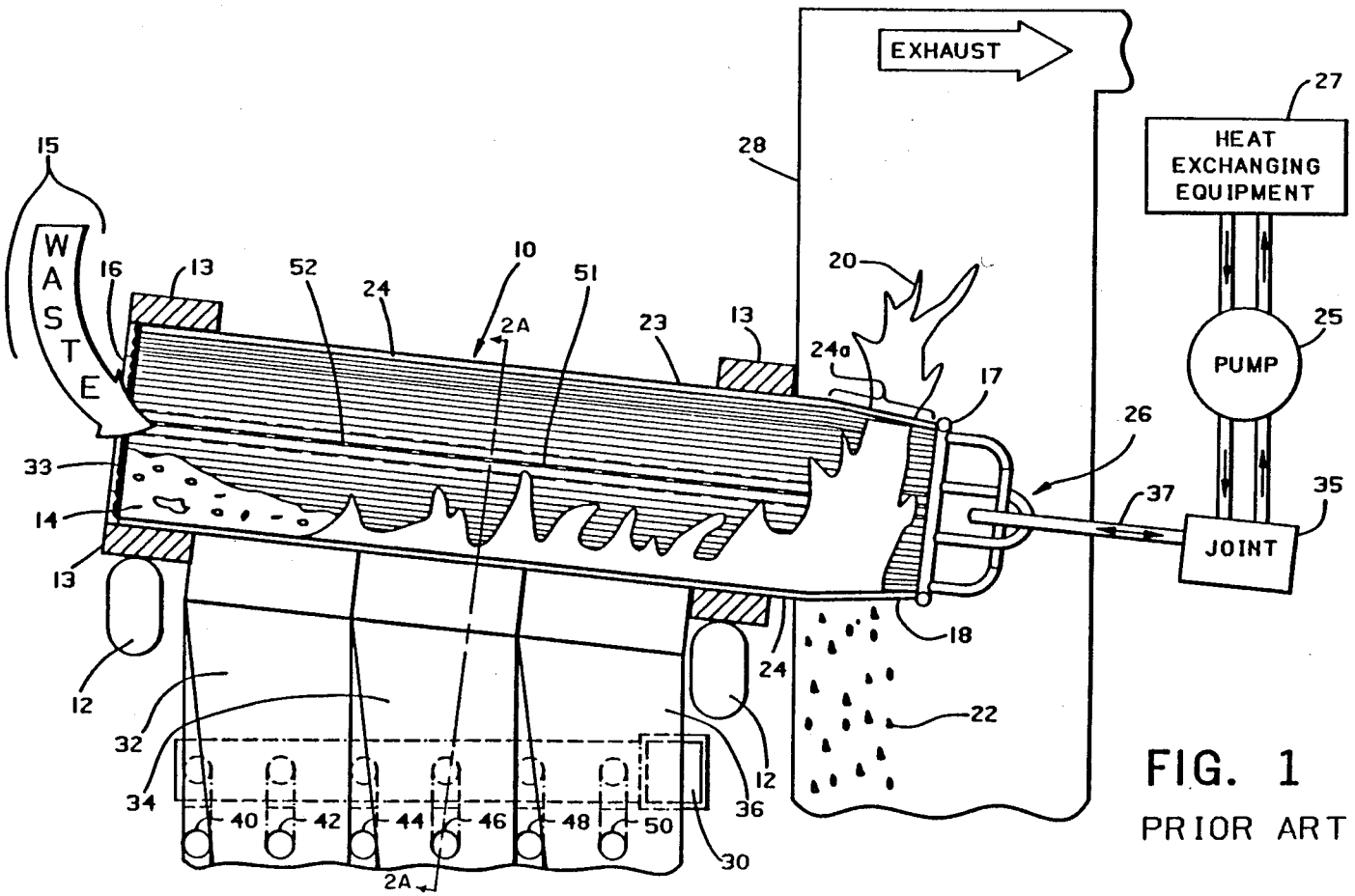
FIG. 1 PRIOR ART
FIG. 1 is a cross-sectional, side elevational schematic view of a conventional rotary combustor.

A conventional water-cooled rotary combustor is illustrated schematically in the cross-sectional, side elevation view of FIG. 1. A rotary combustor normally includes a combustion barrel 10 having a generally cylindrical side wall 23 formed of longitudinally extending cooling pipes 24 arranged in spaced axial relationship. The cooling pipes 24 are encircled by and secured to bands 13 which in turn are supported by rollers 12. The combustion barrel 10 receives solid waste 14 at an input end 16 and discharges heat 20 and solid combustion products 22, e.g., ash, at an exit end 18. The combustion barrel 10 may be rotated by driving the rollers 12 or by a separate ring gear (not shown) affixed to the barrel and driven by a pinion, as disclosed in U.S. Pat. No. 3,822,751 to Harris et al.

The combustion barrel 10 has a central axis of rotation which is inclined slightly from the horizontal, proceeding downward away from the input end 16 to the exit end 18. Combustion air is forced into the barrel 10 through gas-porous interconnections 51 between adjacent cooling pipes 24 by windboxes, including wind boxes 32, 34 and 36 illustrated in FIG. 1. The gas-porous interconnections 51 may be formed of perforated metal webs constructed of bar steel perforated by openings 52. The interconnections 51 extend from the input end 16 and along the generally straight axial portions of pipes 24 to an angled section or truncated conical section, 24*a* which is received within a flue 28. No interconnections 51 are included in the angled section 24*a*, in which the cooling pipes 24 extend in somewhat converging relationship to the exit end 18 of the barrel 10. The lack of interconnections 51 in the angled section 24*a* permits flue gas 50 and ash 22 to escape easily from the barrel 10.

The temperature of cooling pipes 24 is maintained at approximately 275° C. by circulating coolant therethrough. The resulting high-energy coolant is routed through a coolant loop which includes a ring header 17, supply pipe 26 a rotary joint 55, pump 25 and heat exchange equipment 27. The supply pipes 26 preferably include a double-walled, or coaxial, pipe 37 for connection to the joint 35 which may be constructed as disclosed in Harris et al. '651. The coolant loop returns low-energy coolant to the ring header 17 via the pump 25, joint 35 and supply pipes 26. Ring header 17 distributes the low-energy coolant received from the heat exchanging equipment 27 to a first set of cooling pipes 24 which transports the coolant the length of the barrel 10 to return means, such as U-tubes 39, or another ring header (not shown) at the input end 16 of the barrel 10. The U-tubes 39 couple the first set of the cooling pipes 34 to a second set of cooling pipes 24 which return the coolant to the ring headers 17 to be discharged to the heat exchanging equipment 27. The heat exchanging equipment 27 may include a boiler, a condenser, connection to a steam driven electrical power generation system, etc. (all not shown), as known in the art.

Figure 2A:
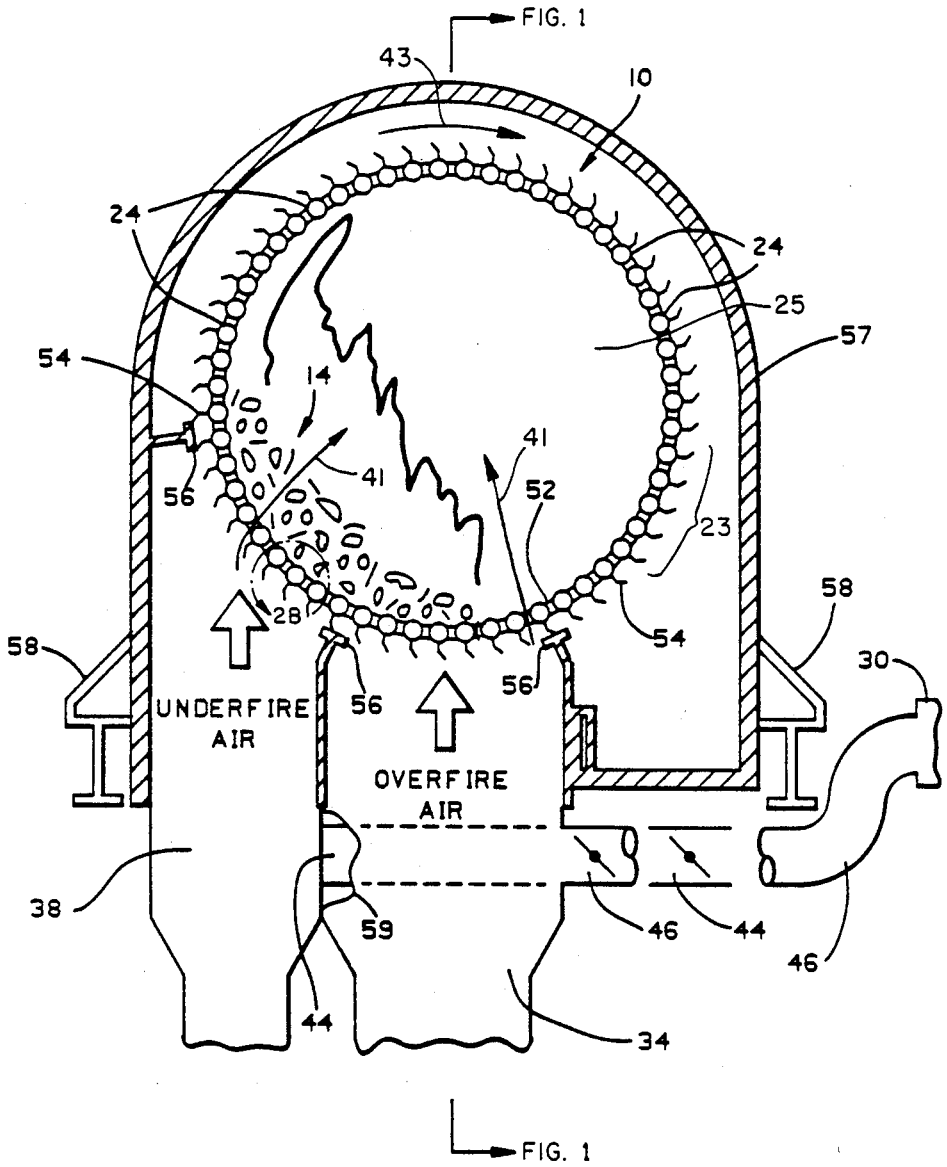
FIG. 2A PRIOR ART
FIG. 2A is a cross-sectional, end elevational schematic view of the rotary combustor illustrated in FIG. 1.
Figure 2B:
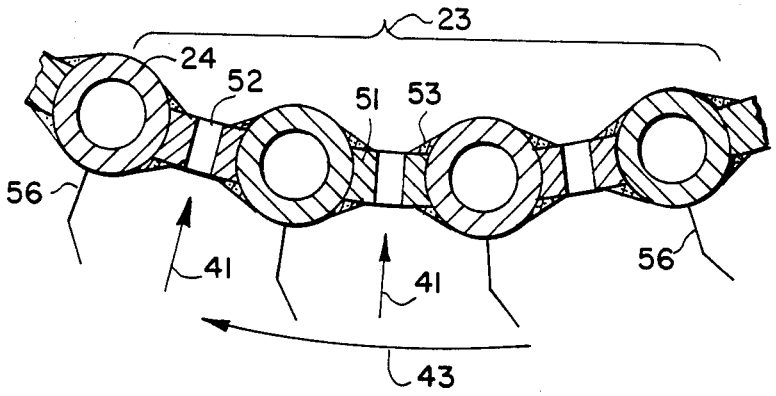
FIG. 2B. PRIOR ART
FIG. 2B is an enlargement of a fragmentary segment of the structure of FIG. 2A.

Referring to FIGS. 1 and 2A, the combustion gas, typically air, is supplied to the combustion barrel 10 by an air duct 30 and windboxes including windboxes 32, 34, 36 and 38. A total of six (6) windboxes are disposed under the combustion barrel 10, but the underfire windboxes adjacent to the overfire windboxes 32 and 36 are not illustrated. Air is transported from the duct 30 to the windboxes via control ducts 40, 42, . . . , 50. As illustrated in FIG. 2, control duct 46 supplies combustion air from the air duct 30 to the middle "overfire" windbox 34, while control duct 34 supplies combusted air to the middle "underfire" windbox 38. The air supplied by air duct 30 may be preheated by the exhaust from the flue 28 and may be blown by a conventional forced draft fan (not shown). Preferably, the combustion air is drawn from a waste input area 15 to provide a source of ventilation for the waste material 14 being loaded into the combustion barrel 10.

FIG. 2A is a schematic cross-sectional, end elevation view of the conventional rotary combustor illustrated in FIG. 1. As illustrated in FIG. 2A, the combustion barrel 10 is housed within an enclosure 57, not illustrated in FIG. 1 for simplicity, which ensures that the flue gas 20 exits via the flue 28. The enclosure 57 is supported on an appropriate surface by supports 58. Cut-away 59 is provided in FIG. 2A to illustrate the control duct 44 which supplies combustion air to underfire windbox 38.

As viewed in FIG. 2A from the exit end 18 (FIG. 1), the combustion barrel 10 rotates in a clockwise direction, as indicated by direction arrow 43. As a result, waste material 14 is lifted to the left side of the combustion barrel 10, as seen in FIG. 2A. Therefore, in all of the overfire windboxes, e.g., windbox 34, there are usually at least a few openings 52 which are not covered by the waste material 14 and thus are able to supply large quantities of air to the interior of the combustion drum 10. On the other hand, the underfire windboxes, e.g., windbox 38, direct air to the base of the waste material 14 to aid in combustion. Ordinarily, the waste material 14 is sufficiently large and irregularly shaped so that a sufficient number of the openings 52 are unblocked above the underfire windboxes, permitting air to penetrate into the waste material 15 in the barrel 10. Typically, the air pressure differential between the windboxes and the barrel 10 is a couple of inches of water, i.e., slightly less than one-tenth (0.1) psi. As illustrated in FIG. 2A, seal strips 54 cooperate with windbox edges 56 to afford a pressure seal between the windboxes and the combustion barrel 10. The seal strips 54 extend longitudinally, i.e., in a parallel-axial direction, along and secured to the exterior of the combustion barrel 10, and have a dog leg-shaped cross-section as illustrated in FIG. 2A. Each of the seal strips 54 is continuous for at least the axial length of one windbox.

As illustrated in FIG. 2A by the air flow arrows 41, while the air flow from the underfire windboxes, e.g., windbox 38, is directed towards the area of combustion, the air from the uncovered openings 52 above the overfire windboxes, e.g., windbox 34, tends to flow toward the center of the barrel where very little combustion occurs. Although there is a slight clockwise rotation of gas (as viewed in FIG. 2A) within the combustion barrel 10 due to the skewed location of the burning fuel, the rotational flow velocity is generally low.

Figure 3A:
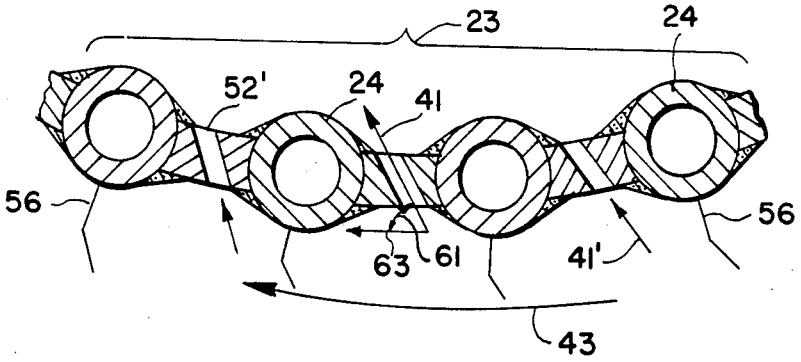
FIG. 3A is a view similar to FIG. 2B for a first embodiment of the present invention.
Figure 4A:
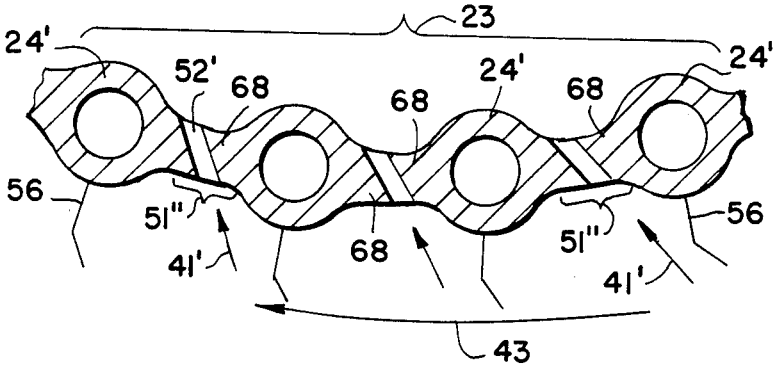
FIG. 4A is a view similar to FIG. 2B for a second embodiment of the present invention.
Figure 3B:
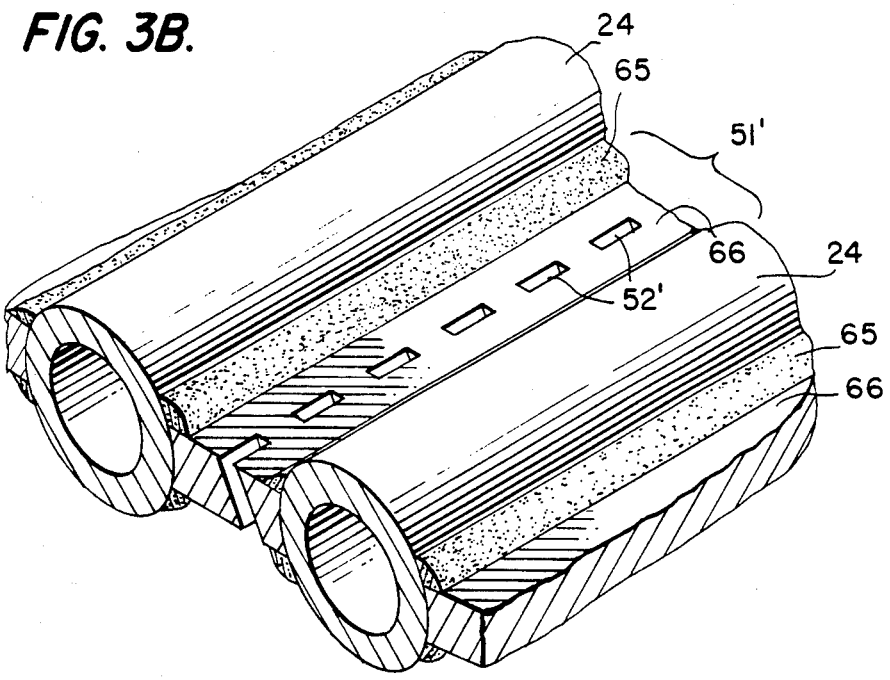
FIG. 3B is a perspective view of a fragmentary portion of the first embodiment of the present invention.
Figure 4B:
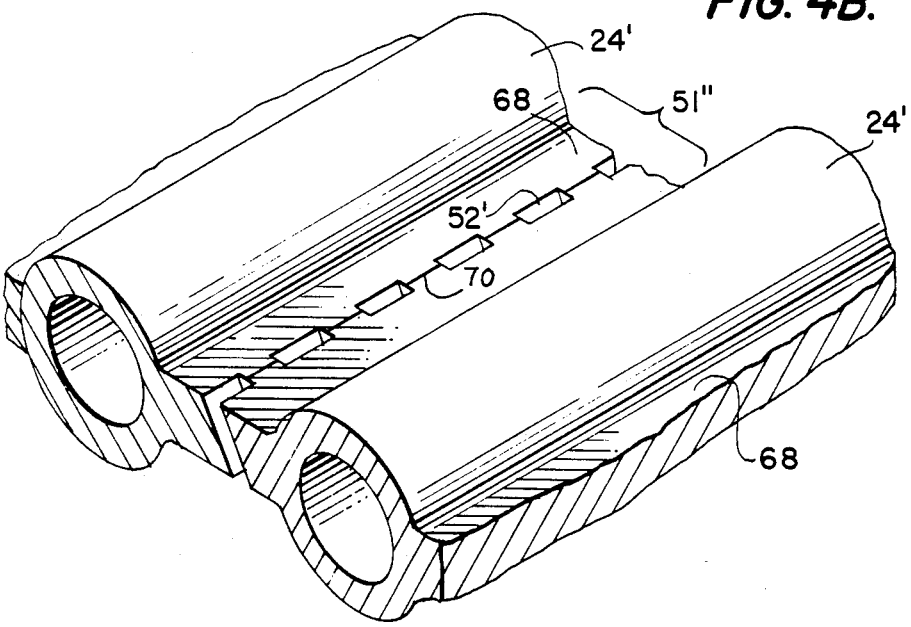
FIG. 4B is a perspective view of a fragmentary portion the second embodiment of the present invention.
Figure 5:
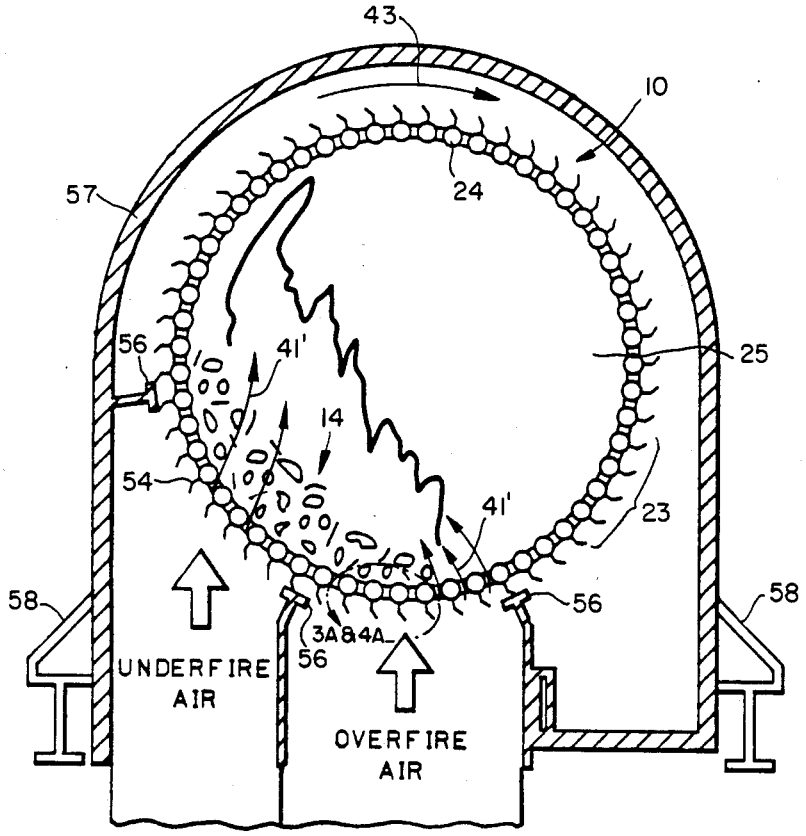
FIG. 5 is a cross-sectional, end elevational schematic view of a rotary combustor according to the present invention.

The present invention avoids this result by using slanted openings 52', as illustrated in cross section in FIGS. 3A and 4A. The slanted openings 52' are formed in gas-porous interconnections 51', constructed as illustrated in FIGS. 3A and 3B, or 51" , constructed as illustrated in FIGS. 4A and 4B. As illustrated in FIG. 3A, the direction of the air flow 41 through the combustion barrel 10 makes an acute angle 61 to a vector 63 corresponding to the direction of rotation of the barrel, as indicated by arrow 43. The angle 61 is preferably approximately 60°±20°. Thus, as illustrated in FIG. 5, the air entering the interior of the barrel 10 is initially directed towards the area immediately above the surface of material 14, where combustion is most active. This enhances the clockwise rotational speed of the air in the combustion barrel 10, promoting the mixing of gasses.

The embodiment illustrated in FIGS. 3A and 3B utilizes conventional construction techniques for forming the cylindrical wall 23. Thus, fillet welds 65 are used to attach perforated webs 66 of steel bar to the pipes 24 to form the gas-porous interconnections 51. The slanted openings of the present invention are provided by the perforations 52' in the steel web 66.

An alternative method of construction of a side wall 23 according to the present invention is illustrated in FIGS. 4A and 4B. In this embodiment, the gas-porous interconnections 51" are formed as integral extensions of the cooling pipes 24'. The slanted openings 52' are provided in the second embodiment by machining the edges of the fins 68 preferably to form flats at the contact points. Such machining may be accomplished by any known technique, including laser cutting or the use of machine tools. The fins 68 may be connected together to form gasporous interconnections 51" by conventional welding techniques, including laser welding, to form welds 70 at the contact points of the fins 68. Examples of how boiler walls can be constructed using finned tubes can be found in U.S. Pat. 3,814,062 to Vollhardt.

In the embodiments illustrated in FIGS. 3A–4B, the opening 52' are formed as a single row of slots with a rectangular cross section. However, the invention is not restricted to the illustrated shape and arrangement of the openings, but applies to openings with circular or non-rectangular polygonal cross sections as well as multiple or staggered rows of openings.

The many features and advantages of the present invention are apparent from the detailed specification and thus, it is intended by the appended claims to cover all such features and advantages of the device which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling within the scope and spirit of the invention.

What is claimed is:

1. A generally cylindrical side wall of a combustion barrel in a rotary combustor used for incinerating solid material with combustion gas from a combustion gas supply entering the interior of the combustion barrel through said side wall to support combustion of the material, the combustion barrel having input and exit ends and said side wall being connected to a coolant loop containing heat exchanging equipment and rotating in a direction of rotation about a central axis of rotation, said side wall comprising:

plural cooling pipes, extending longitudinally in parallel, spaced axial relationship, having connections to the coolant loop at at least one of the input and exit ends; and plural gas-porous interconnections having openings therein, the openings directing the combustion gas from the combustion gas supply into the interior of the combustion barrel at an acute angle to a vector corresponding to the direction of rotation.

2. A side wall of a rotary combustor as recited in claim 1, wherein the acute angle is approximately 60°±20°.

3. A side wall of a rotary combustor as recited in claim 2, wherein said gas-porous interconnections each comprises:

a perforated metal web, the openings formed along a center line thereof; and fillet welds joining said metal web to adjacent cooling pipes.

4. A side wall of a rotary combustor as recited in claim 2, wherein said cooling pipes include integral fins with uneven edges substantially perpendicular to the interior surface of the combustor barrel; and wherein said gas-porous interconnections include welds at contact points of adjacent cooling pipes and the openings in said gas-porous interconnections are formed where the fins of the adjacent cooling pipes separate from one another due to the uneven edges.

5. A side wall of a rotary combustor as recited in claim 4, wherein the uneven edges of the fins of said cooling pipes are formed by machining flats at the contact points.

6. A side wall of a rotary combustor as recited in claim 5, wherein the machining includes laser cutting.

7. A side wall of a rotary combustor as recited in claim 6, wherein the welds are formed by laser welding.

8. A side wall of the rotary combustor as recited in claim 4, wherein the welds are formed by laser welding.

9. A generally cylindrical side wall of a combustion barrel in a rotary combustor used for incinerating solid material with air from windboxes underlying the combustion barrel entering the interior of the combustion barrel through said side wall to support combustion of the material, the combustion barrel having input and exit ends and said side wall being connected to a coolant loop containing heat exchanging equipment and rotating in a direction of rotation about a central axis of rotation, said side wall comprising:

plural cooling pipes, extending longitudinally in parallel, spaced axial relationship, having connections to the coolant loop at the exit end of the combustion barrel; and plural perforated metal webs, joined to adjacent cooling pipes by fillet welds, having openings therein, the openings directing the air from the windboxes into the interior of the combustion barrel at an angle of approximately 60°±20° to a vector corresponding to the direction of rotation.

10. A generally cylindrical side wall of a combustion barrel in a rotary combustor used for incinerating solid material with air from windboxes entering the interior of the combustion barrel through said side wall to support combustion of the material, the combustion barrel having input and output ends and said side wall being connected to a coolant loop containing heat exchanging equipment and rotating in a direction of rotation about a central axis of rotation, said side wall comprising:

plural cooling pipes, extending longitudinally in parallel, spaced axial relationship, having connections to the coolant loop at the exit end of the combustion barrel, said cooling pipes including integral fins with uneven edges substantially perpendicular to the interior surface of the combustion barrel; and welds connecting the uneven edges of adjacent cooling pipes at contact points thereof, whereby openings are formed between the adjacent cooling pipes, the openings directing the air from the windboxes into the interior of the combustion barrel at an angle of approximately 60°±20° to a vector corresponding to the direction of rotation.

11. A side wall of a rotary combustor as recited in claim 10, wherein the uneven edges of the fins of said cooling pipes are formed by machining flats at the contact points.

12. A side wall of a rotary combustor as recited in claim 10, wherein the machining includes laser cutting.

13. A side wall of a rotary combustor as recited in claim 10, wherein the welds are formed by laser welding.

* * * * *